US006827014B1

(12) United States Patent
Marshall et al.

(10) Patent No.: US 6,827,014 B1
(45) Date of Patent: Dec. 7, 2004

(54) SYSTEM FOR MOUNTING, USING AND STORING RUBBER STAMPS

(75) Inventors: F. William Marshall, Huntington Beach, CA (US); George Harry Ostiz, Huntington Beach, CA (US)

(73) Assignee: F. W. Marshall, Inc., Huntington Beach, CA (US)

( * ) Notice: Subject to any disclaimer, the term of this patent is extended or adjusted under 35 U.S.C. 154(b) by 0 days.

(21) Appl. No.: 10/442,698

(22) Filed: May 21, 2003

(51) Int. Cl.[7] ..... B41F 13/00; B41M 1/12; B41L 47/02

(52) U.S. Cl. ..... 101/327; 101/129; 101/368; 101/405; 101/483

(58) Field of Search ..... 101/327, 368, 101/405, 129, 483; 180/3

(56) References Cited

U.S. PATENT DOCUMENTS 4,186,786 A * 2/1980 Kirkpatrick ..... 383/63
5,172,633 A * 12/1992 Hung ..... 101/128.4
5,303,647 A * 4/1994 Seo et al. ..... 101/125
5,313,885 A 5/1994 Winston ..... 101/405
D364,183 S 11/1995 Winston ..... 101/333
5,870,953 A * 2/1999 Winston ..... 101/333
6,244,180 B1 * 6/2001 Winston ..... 101/405
6,324,977 B1 12/2001 Hadden ..... 101/405
6,415,714 B2 * 7/2002 Winston ..... 101/327
6,422,140 B1 * 7/2002 Lookholder et al. ..... 101/129

* cited by examiner

*Primary Examiner*—Andrew H. Hirshfeld
*Assistant Examiner*—Marvin P. Crenshaw
(74) *Attorney, Agent, or Firm*—James G O'Neill; Klein, O'Neill & Singh, LLP

(57) ABSTRACT

A kit or system having means for mounting, using and storing rubber stamps with an elastomeric image on one surface, a foam backing and a static cling second surface for temporary securement to a handle or to a storage medium, such as a board, sheet or folder. The kit may selectively include a storage sheet, board or folder or a number of each having inside and outside surfaces with a thermal polyester film on at least the inside surfaces, held in an easily opened and closed transparent bag. The kit may also include one or more acrylic handles.

19 Claims, 2 Drawing Sheets

FIG. 1
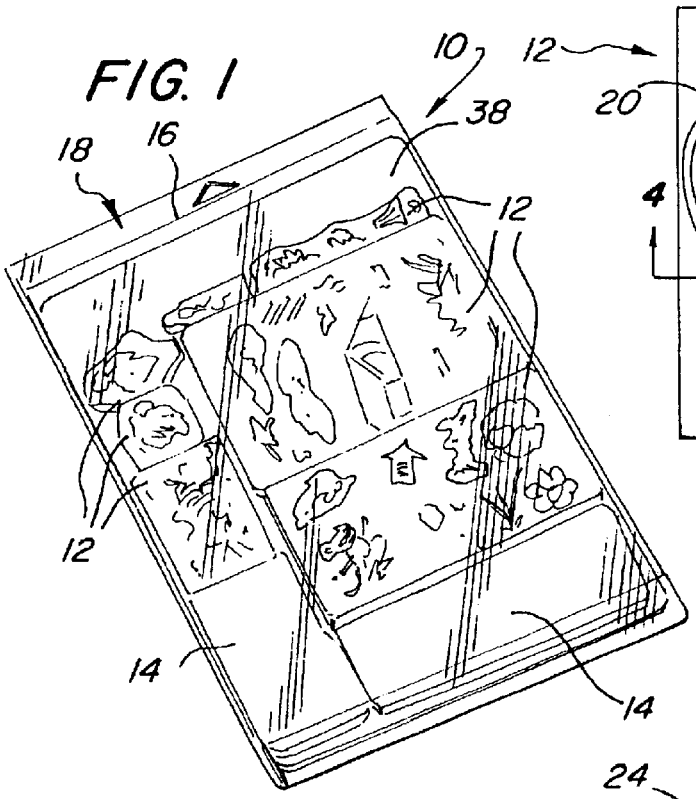
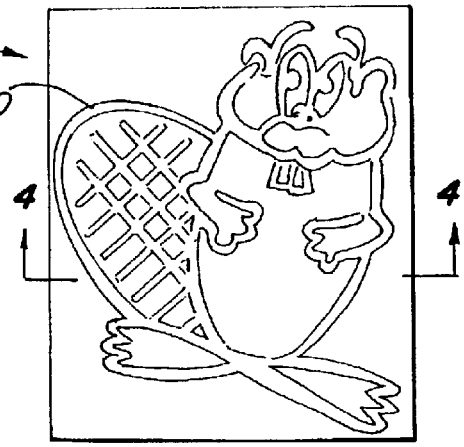
FIG. 3
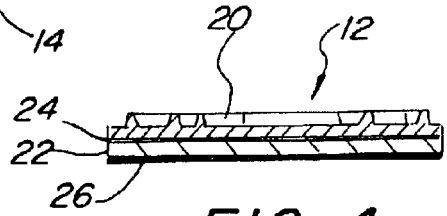
FIG. 2
FIG. 4
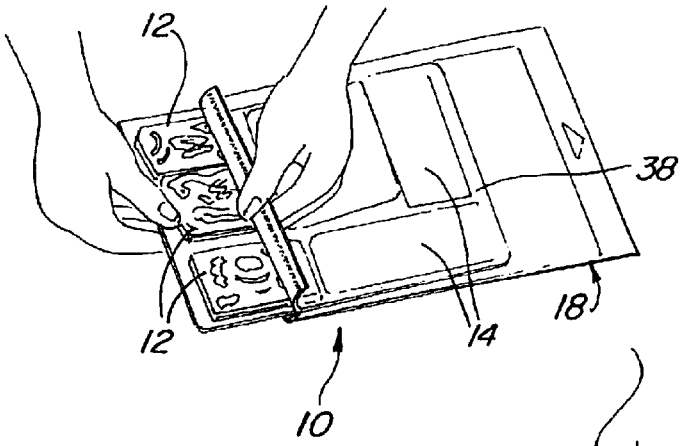
FIG. 5
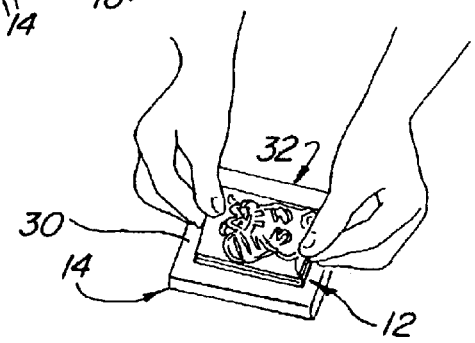

FIG. 6
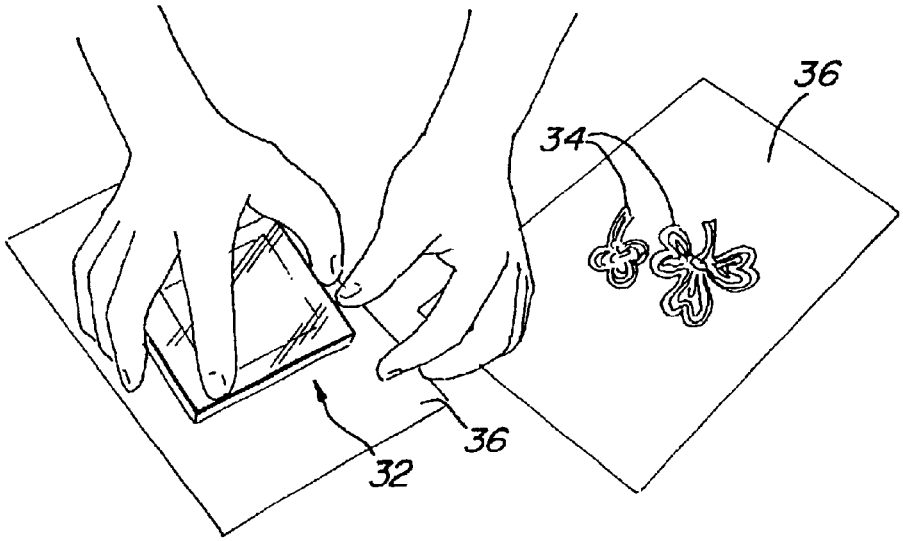
FIG. 7
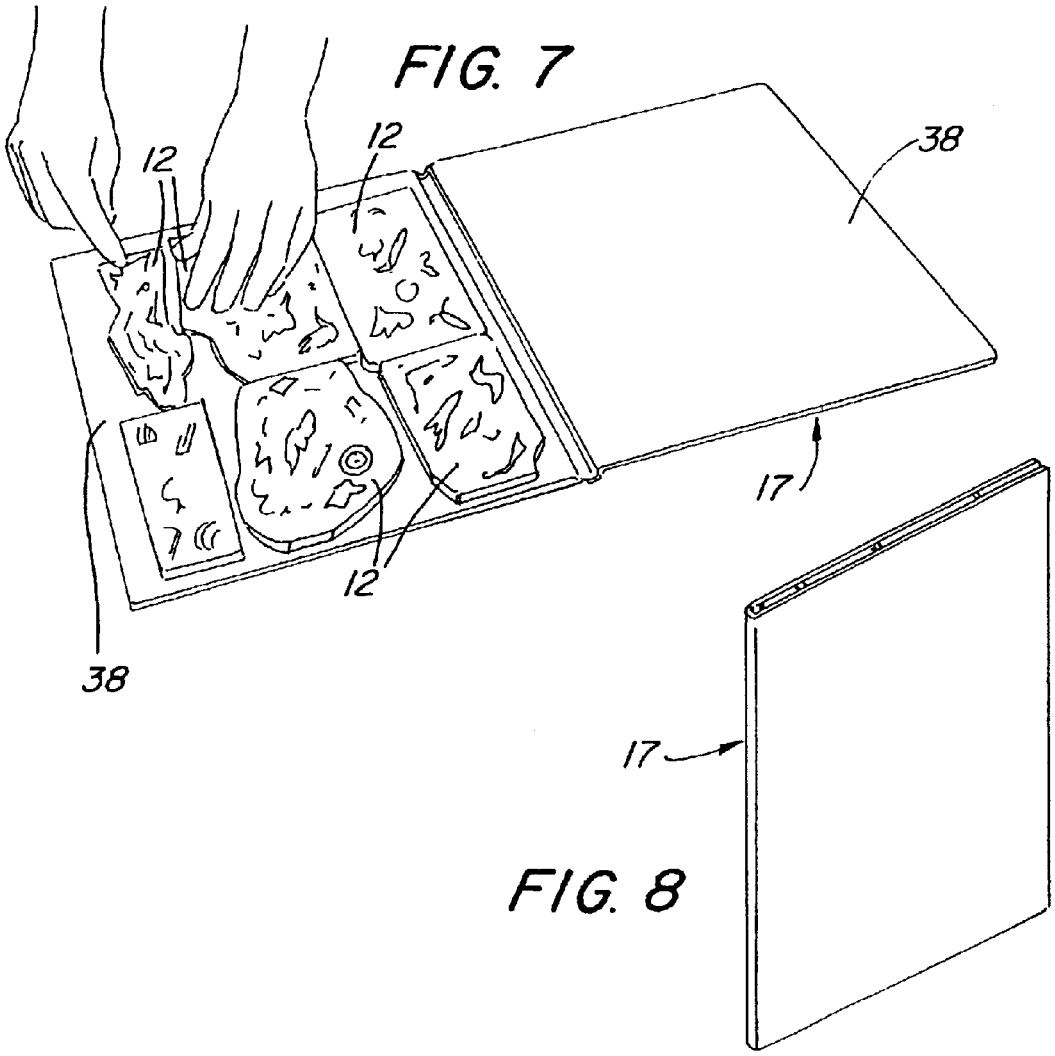
FIG. 8

SYSTEM FOR MOUNTING, USING AND STORING RUBBER STAMPS

BACKGROUND OF THE INVENTION

1. Field of the Invention

This invention generally relates to ink stamps and, more particularly, to an improved system for mounting, using and storing rubber stamps.

2. Description of the Prior Art

Many types of stamping devices and methods have been developed over the years for stamping inked and other images on paper and other surfaces to produce a wide variety of items. These stamping devices are usually made with a plastic, wooden or other type of handle having an elastomeric material, with an image formed thereon, secured to a bottom surface of the handle. The elastomeric material is usually permanently secured to the handle so that large numbers of stamps are needed if different images are to be created.

To overcome the need for a large number of separate stamps, various devices have been developed with handles having detachable elastomeric dies or embossed members so that the handles may be used with more than one die or embossed member. Examples of such devices are disclosed in U.S. Pat. No. 5,313,885 to Winston and U.S. Pat. No. 6,324,977 to Hadden. These patents disclose various attachment means for the elastomeric dies or flexible embossed members, such as temporary adhesive, closed cell foams, hand held stretch film, magnetic material, suction cups, vinyl sheet film or water may be used. These attaching means do not always work to maintain the attached die or embossed members in the required position and tend to be expensive, thereby increasing the cost of manufacturing such devices. Furthermore, the known devices do not provide means for storing the elastomeric dies or flexible embossed members when not in use.

Therefore, there exists a need in the art for an improved, inexpensive and easy to use system for mounting and using rubber stamps and for storing rubber stamps when not in use for ready accessibility and improved safety against loss and/or damage.

SUMMARY OF THE INVENTION

It is, therefore, a general object of the present invention to provide an improved stamping system. It is a particular object of the present invention to provide an improved stamping system having at least one easily movable elastomeric die or flexible embossed member for mounting to a handle. It is yet another particular object of the present invention to provide an improved stamping system having at least one elastomeric die or flexible embossed assembly mounted on precut foam backing having a cling surface for selectively mounting on a handle or storage means for removed or unused elastomeric die assemblies, or the like. It is also a particular object of the present invention to provide an improved method of assembling a kit having the necessary components for forming, using and storing rubber stamps in a convenient and simple manner.

These and other objects and advantages of the present invention are achieved by providing a kit or system having means for mounting, using and storing rubber stamps with an elastomeric die on one surface, a foam backing and a static cling second surface for temporary securement to a handle or to a storage medium.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 1 is a perspective view looking toward the top of a preferred embodiment of a kit of the present invention comprising a transparent storage bag having a plurality of rubber stamp assemblies, optional handles and at least one storage means for the rubber stamp assemblies;

FIG. 2 is a further perspective view of the kit of FIG. 1 showing the storage bag in an open position and the items of the kit being inserted or removed therefrom;

FIG. 3 is a top plan view of a rubber stamp assembly of the present invention looking toward the image;

FIG. 4 is a cross-sectional view of rubber stamp assembly taken along line 4—4 of FIG. 3;

FIG. 5 is a perspective view showing a person dismounting or mounting of a rubber stamp assembly to a handle;

FIG. 6 is a further perspective view showing the rubber stamp assembly mounted on a handle as shown in FIG. 5, being used to stamp an image on a piece of paper adjacent a further piece of paper with images stamped thereon;

FIG. 7 is a further perspective view showing a plurality of removed or unused rubber stamps mounted on one side of a storage means; and FIG. 8 is a further perspective view showing the storage means of FIG. 7 in a folded position ready for storage, transport or use.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to describe an improved system and method for mounting, using and storing rubber stamps.

Turning now to the drawings, there shown is a preferred embodiment of a kit or system of the present invention, generally indicated at 10. The kit or system 10 is preferably comprised of at least one rubber stamp assembly 12, of any desired size and shape and at least one storage element or medium 16. If desired, at least one handle 14 of any desired size and shape may be inserted and held in the kit 10. The items in the kit or system kit 10 are held in an easily opened and closed reusable bag or holder 18, preferably transparent, or may be held in or transferred to a further protective carrier or holder selected by a user.

The kit 10 preferably comprises a plurality of rubber stamp assemblies 12, which assemblies are preferably pre-trimmed closely around the images and permanently mounted to a foam material, referred to as EZ Mount, as described below. The kit 10 may optionally include a plurality of handles 14, which handles are preferably plastic, such as acrylic, and transparent, although they may also be opaque. As indicated in FIG. 5, each handle 14 has two substantially flat opposed surfaces 30 to which the plurality of EZ Mount rubber stamp assemblies 12 may be selectively removably secured. The handles 14 may also be held or stored elsewhere, and used with the rubber stamp assemblies 12 when the rubber stamp assemblies are removed from the kit and/or a storage element or medium 16.

Additionally, the kit 10 comprises at least one storage element or medium 16, as explained more fully below. Or, one or more separate storage boards or sheets 16 or folders 17 may be provided for selectively mounting the EZ Mount rubber stamp assemblies 12. That is, the EZ Mount rubber stamp assemblies 12 may be selectively removably secured to handles 14, or the storage means 16 or 17 when not in use. Additional storage elements or mediums 16 and/or 17 may also be provided separately for storing additional rubber stamp assemblies 12.

Each of the rubber stamp assemblies 12 may have a different image 20 formed thereon, in a manner well know to those skilled in the art, for stamping images on paper or other surfaces (see FIG. 6). As best shown in Fit 4, the rubber stamp assemblies 12 are comprised of the image layer 20 permanently secured by a rear surface to a mounting foam or layer 22 via a permanent adhesive layer 24. The bottom surface of the rubber stamp assembly 12, and, in particular, the bottom layer of the foam 22 is provided with or has permanently secured thereto a layer of material 26 that allows rubber stamp assemblies to be selectively removably secured to a flat clean surface of one or more the handles 14, or to a storage element or medium 16 or 17, when not in use. This permanent layer of material 26 is referred to as a static-cling or a removable pressure-sensitive material, such as a vinyl sheet film, or, for example, a material such as that used on removable Avery labels. This permanent layer of material 26 enables the rubberstamp assemblies 12 to be accurately and quickly attached to or removed from various handles 14 and to be safely stored on a surface made from a thermal polyester film laminated to one or both sides of a sheet of paper such as 16, or a chip board or the like, used to form storage boards or sheets 16 or folders 17. The thermal polyester film applied to the storage element or medium 16, or 17, may be any desired thickness, but is generally between about 2 mils to 10 mils thick.

In a currently preferred embodiment of the invention, the kit 10 has a single sheet storage sheet 16, preferably made from a white stock material with a film laminate on at lease one side or surface and printing, such as a printed index of what is contained in the kit, on at least one side, preferably the opposite side or surface. The printing or printed index is preferably multicolor for advertising and aesthetic purposes.

The storage sheet 16 may be replaced by a storage board or panel in the kit 10, or one or more storage boards or panels may be separately provided. The storage boards or panels are preferably thicker than the sheets, for example made from a black board or a chip board and having 3 holes punched along one side edge for insertion of the board or panel into a 3 ring binder. The storage board or panel 16 also preferably has the film laminate secured to both sides so that rubber stamp assemblies may be selectively stored on both sides.

The storage folders 17 (see FIGS. 7 and 8), which may be provided with the kit 10, but which are preferably separately provided, are comprised of two or more storage panels of boards, such as those described above, without 3 holes punched therein, and with side edges secured together by a hinge means to form a folder or notebook having film laminate on inside surfaces 38 so that a plurality of rubber stamp assemblies 12 may be removably secured on the inside surfaces for more permanent and protected storage or transportation, with the folder in the closed position, as shown in FIG. 8.

As best shown in FIGS. 4–6, the pressure sensitive material or static cling surface 26 is applied to a smooth non-abrasive surface on one side 30 of the handle 14 to form a complete stamped 32 for forming linked images 34 on one or more sheets of paper or other similar surfaces 36.

As shown in FIGS. 1, 2, 7 and 8, after forming an image on the surface of paper or the like 36, or when otherwise not in use, the rubber stamp assemblies 12 are removed from the flat surface 30 of a handle 14 and applied to a clean flat surface 38 on a storage element or medium, such as the board, panel or sheet 16, or in the folder 17. The rubber stamp assemblies 12 will cling or be held to the surface 38 in or on the storage element or medium, and may be inserted into the reusable bag or holder 18 or a further protective carrier or holder selected by a user, until needed. For example, as explained above, the storage boards or panels 16 may have the 3 holes formed therein inserted into a notebook, or the storage boards or panels may be inserted into the folder 17, if sufficient space remains in the folder.

The kit one or more of the rubber stamp assemblies, and/or handles 14 if held therein, to be easily pulled from the storage means 18, to thereby allowing a person to easily mount and use various sized and shaped rubber stamp assemblies on the handles to form images, and to then easily remove rubber stamp assemblies from the handles so as to store the assemblies in any of the disclosed storage means, and/or store the handles for later use.

In use, the improved kit 10 of the present invention is assembled by placing any desired number of rubber stamp assemblies, handles and storage boards, sheets or folders in a holding or storage bag, or the like, preferably transparent, for convenient shipment, storage or use. A person wishing to stamp images can view the items held in the transparent holding or storage bag and select the desired items for assembly with other selected items, as needed, for use. The used items may then be disassembled and returned to the holding or storage bag and/or other holding or storage means, where they may be safely held and easily located for subsequent use.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. A system for storing stamp sets, comprising:

a transparent holding container;

at least one storage element held in the transparent holding container; the storage element having a first side and a second side with a thermal polyester film on at least one side;

said storage element being sectionalized having a first storage section containing at least one acrylic handle and a second storage section containing at least one pre-trimmed rubber stamp assembly having a first surface with an image thereon, a foam center portion and a second surface having a flat surface with a static-cling material thereon for removably mounting on at least one handle.

2. The system of claim 1, wherein there are a plurality of pre-trimmed rubber stamp assemblies removably held in the transparent holding container on the thermal polyester film.

3. The system of claim 1 wherein there are a plurality of storage elements held in the transparent holding container.

4. The system of claim 3 wherein the plurality of storage elements are sheets having the thermal polyester film on the first side and printing on the second side.

5. The system of claim 4 wherein the plurality of storage elements are boards having the thermal polyester film on the first side and the second side.

6. The system of claim 3 wherein the plurality of storage elements are folders having inside and outside surfaces with the thermal polyester film on at least the inside surfaces.

7. The system of claim 3 wherein there are a plurality of acrylic handles held in the transparent holding container.

8. The system of claim 1 wherein the plurality of storage elements are sheets having the thermal polyester film on the first side and printing on the second side.

9. The system of claim 1 wherein the plurality of storage elements are boards having the thermal polyester film on the first side and the second side.

10. The system of claim 1 wherein the plurality of storage elements are folders having inside and outside surfaces with the thermal polyester film on at least the inside surfaces.

11. The system of claim 1 wherein the transparent holding container contains a plurality of acrylic handles and a plurality of pre-trimmed rubber stamp assemblies held on thermal polyester film sides of a plurality of storage elements.

12. The system of claim 11 wherein the plurality of storage elements are sheets having the thermal polyester film on the first side and a printed index in color on the second side.

13. The system of claim 11 wherein the plurality of storage elements are boards having the thermal polyester film on the first side and the second side.

14. The system of claim 11 wherein the plurality of storage elements are folders having inside and outside surfaces with the thermal polyester film on at least the inside surfaces.

15. A kit for mounting, using and storing rubber stamps, comprising:

a transparent holding container;

at least one acrylic handle held in the transparent holding container;

at least one pre-trimmed rubber stamp assembly removably held in the transparent holding container, the at least one pre-trimmed rubber stamp assembly having a first surface with an image thereon, a foam center portion and a second flat surface with a static-cling material thereon for removably mounting on a flat smooth surface of the at least one acrylic handle; and at least one storage element held in the transparent holding container, the at least one storage element having a first side and a second side with a thermal polyester film on the first side for removably storing the at least one pre-trimmed rubber stamp assembly said storage element being sectionalized having a first storage section holding said handle and a second storage section holding said stamp.

16. The kit of claim 15 wherein the transparent holding container contains a plurality of acrylic handles, a plurality of pre-trimmed rubber stamp assemblies and a plurality of storage elements.

17. The kit of claim 16 wherein the plurality of storage elements are sheets having the thermal polyester film on the first side and a printed index in color on the second side.

18. The kit of claim 16 wherein the plurality of storage elements are boards having the thermal polyester film on the first side and the second side.

19. The kit of claim 16 wherein the plurality of storage elements are folders having a plurality of inside and outside surfaces with the thermal polyester film on the inside surfaces.

* * * * *